United States Patent [19]

Mattsson

[11] Patent Number: 4,538,506

[45] Date of Patent: Sep. 3, 1985

[54] CYLINDER WITH TWO-STEP MOVEMENT

[75] Inventor: Karl E. Mattsson, Näsum, Sweden

[73] Assignee: AB Volvo, Gothenburg, Sweden

[21] Appl. No.: 611,970

[22] PCT Filed: Sep. 22, 1983

[86] PCT No.: PCT/SE83/00334

§ 371 Date: May 15, 1984

§ 102(e) Date: May 15, 1984

[87] PCT Pub. No.: WO84/01192

PCT Pub. Date: Mar. 29, 1984

[30] Foreign Application Priority Data

Sep. 23, 1982 [SE] Sweden ..... 8205447

[51] Int. Cl.[3] ..... F15B 15/24; F01B 7/00

[52] U.S. Cl. ..... 92/13.3; 92/13.6; 92/62; 92/75; 92/108

[58] Field of Search ..... 92/13.3, 13.6, 13.8, 92/62, 75, 108, 166; 91/167 R

[56] References Cited

U.S. PATENT DOCUMENTS

| | | | |
|---|---|---|---|
| 2,596,471 | 5/1952 | Densmore | 91/167 R |
| 3,139,004 | 6/1964 | Haumann | 92/62 |
| 3,150,563 | 9/1964 | Carrigan et al. | 92/62 |
| 3,168,853 | 2/1965 | Prince | 91/167 R |
| 3,968,735 | 7/1976 | Boisde | 92/62 |
| 4,076,465 | 2/1978 | Pauliukonis | 92/13.3 |

FOREIGN PATENT DOCUMENTS

| | | | |
|---|---|---|---|
| 2247596 | 4/1974 | Fed. Rep. of Germany . | |
| 163860 | 7/1958 | Sweden . | |
| 625711 | 7/1949 | United Kingdom | 91/167 R |
| 743603 | 1/1956 | United Kingdom | 92/62 |

*Primary Examiner*—Paul E. Maslousky

*Attorney, Agent, or Firm*—Young & Thompson

[57] ABSTRACT

In a cylinder with two-step movement there is in a housing (7) a first piston (6) which slides in contact with the inside of the housing. A second piston (10), which supports a piston rod (11), which moves sealingly through a first end-piece (8) also slides against the inside of the housing. In the second end-piece (9) of the housing, there is a pressure medium tube (12) passing through the first piston (6) and which extends with its end distant from the second end-piece (9) into, and is guided against the inside of the tubular piston rod (11).

13 Claims, 2 Drawing Figures

CYLINDER WITH TWO-STEP MOVEMENT

The present invention relates to a cylinder with a two-step movement, especially a welding gun cylinder for use in welding, there being in a housing with a first and a second end-piece, a first piston sliding in contact with the inside of the housing and a second piston arranged coaxially with the first piston and supporting a piston rod which moves sealingly through the first end-piece of the housing, there being mounted in the second end-piece a pressure medium tube passing through the first piston and through which pressure medium can be led into or out of a first chamber between the first and the second pistons, and there being between the first end-piece and the second piston a second chamber, and between the second end-piece and the first piston a third chamber, the second and the third chambers each having a pressure medium connection.

In electrical resistance welding it is often necessary to be able to move the electrodes relatively far apart to be able to change workpieces for example. During the actual welding, however, the electrodes only need to be separated a short distance to permit movement of the workpiece between different welding points. Welding gun cylinders suitable to this purpose are known in a number of different forms, for example according to Swedish Patent No. 7811488-1. In this known cylinder, the first piston slides against the inside of the housing, while the second piston runs inside the first piston. The two pistons thus have different diameters, and the first piston has a complicated shape.

The purpose of the invention is to achieve a cylinder with a simplified piston design.

This is achieved according to the invention which is characterized in that the second piston also slides in contact with the inside of the housing and in that the pressure medium tube protrudes with its end distant from the second end-piece into, and is guided against the inside of, the tubular piston rod. Thus standardized cylinder tubes can be used, at the same time as the diameter of the second piston follows established standard.

The pressure medium tube can suitably guide the movement of the first piston.

The invention will be described in more detail below with the aid of an example shown in the accompanying drawings, where:

Figure 1:
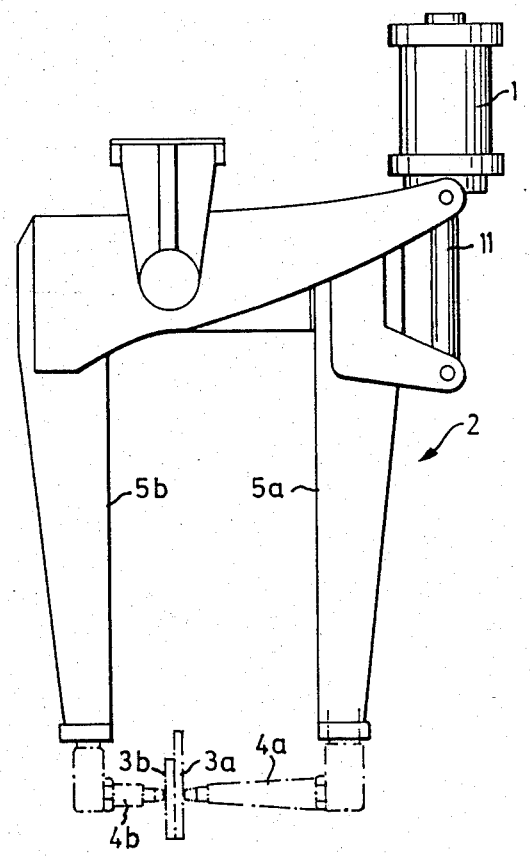
FIG. 1 shows the use of a cylinder according to the invention.

FIG. 1 shows schematically how a cylinder 1 according to the invention is used as a welding gun cylinder and is mounted in a welding gun 2 of tong type, where it is used to fix two pieces 3*a* and 3*b* which are to be welded together with the aid of two electrodes 4*a* and 4*b*. The welding electrode 4*a* is movable and is supported by an arm 5*a* pivoted in the welding gun 2 and which is actuated by a piston rod 11 of the cylinder 1. The welding electrode 4*b* is fixed and is supported by a fixed arm 5*b* of the welding gun 2.

At rest, for changing workpieces for example, the movable welding electrode 4*a* assumes an outer position (not shown). When welding is to take place, the welding electrode 4*a* is swung inwards to an operating position in which the pieces 3*a* and 3*b* are placed in the correct position for welding. The welding electrode 4*a* is then moved still further inwards to the welding position shown in which the pieces 3*a* and 3*b* are pressed together and welding takes place. When changing the welding point, the welding electrode 4*a* is swung back to the operating position so that the pieces 3*a* and 3*b* can be moved the required distance. It may be necessary to swing the welding electrode 4*a* all the way back to the rest position, if required by the shape of the pieces 3*a* and 3*b*.

Figure 2:
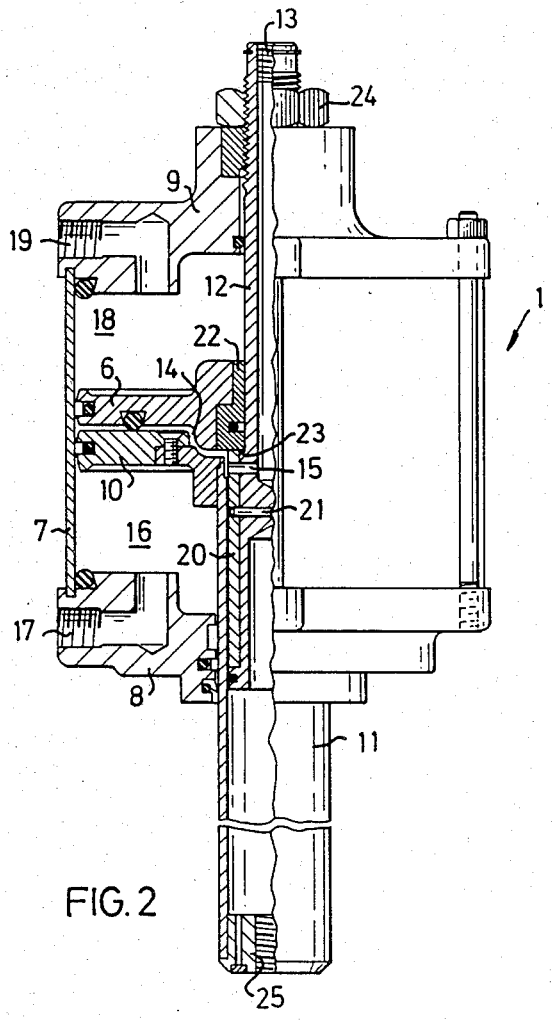
FIG. 2 shows, partially in longitudinal section, a cylinder according to the invention.

The construction of a cylinder 1 according to the invention is revealed in FIG. 2. A first piston 6 is axially displaceable in a housing 7 which has a first end-piece 8 and a second end-piece 9. Between the first piston 6 and the first end-piece 8 there is a second piston 10, which, as does the first piston 6, slides against the inside of the housing 7. This second piston supports a tubular piston rod 11, which slides sealingly through the first end-piece 8.

In the second end-piece 9, there is mounted a pressure medium tube 12 on which the first piston 6 slides. With its end distant from the end-piece 9 the pressure medium tube 12 extends into and is sealingly guided against the inside of the piston rod 11. Outside the second end-piece 9, the pressure medium tube 12 is provided with a pressure medium connection 13 which is in communication with a chamber 14 arranged between the first and the second piston via a hole 15 in the wall of the pressure medium tube 12.

Between the first end-piece 8 and the second piston 10 there is a second chamber 16 to which a pressure medium connection 17 belongs. Between the first piston 6 and the second end-piece 9 there is a third chamber 18 to which a pressure medium connection 19 belongs.

The end of the pressure medium tube 12 which sticks into the piston rod 11 is in contact with the inside of the piston rod via a slide sleeve 20 which is fixed axially to the pressure medium tube 12 with the aid of a pin 21.

The first piston 6 is provided with a bushing 22 for sealed guidance against the pressure medium tube 12, which is provided with a stop 23, here in the form of a surrounding flange, for limiting the axial movement of the first piston 6. The pressure medium tube 12 is screwed into the second end-piece 9 and can be locked axially, with a lock nut 24, in various positions relative thereto. Thus the stop 23 can be moved axially to change the length of stroke of the first piston 6.

The free end of the piston rod 11 is provided with a connection 25 for an electrode or an extension part for example.

The cylinder 1 according to the invention functions as follows: In the rest position, the second chamber 16 is pressurized while the first chamber 14 and the third chamber 18 are without pressure. The first piston 6 will thus be in its upper position near the second end-piece 9, and the second piston 10 will also be in its upper position next to the first piston 6. The piston rod 11 will thus be in its most retracted position to facilitate changing the workpiece.

By thereafter pressurizing the third chamber 18 and adapting the pressure in relation to the pressure in the second chamber 16, the operating position shown in FIG. 2 can be achieved where the first piston 6 has pressed down the second piston 10 and thus pressed out the piston rod 11. In the position shown, the movement of the first piston 6 has been stopped by the stop 23 on the pressure medium tube 12. The cylinder 1 is now in a position where small displacements of the workpiece between the electrodes are still possible. For the actual welding operation, the first piston 6 is held in its position shown in FIG. 2, while an increasing pressure in the first chamber 14 displaces the second piston 10 and thus the piston rod 11 further downwards so that the workpiece is pressed between the electrodes so that welding can take place.

In order to then be able to move the workpiece to a new welding point, the pressures in the first chamber 14 and the second chamber 16 are adjusted in such a way that the second piston 10 is raised, while the first piston 6 remains in its position shown in FIG. 2. The return to the rest position is achieved by depressurizing the first chamber 14 and the third chamber 18 while the second chamber 16 is pressurized.

The pressure medium tube 12 thus serves as a guide for both the first piston 6 and the second piston 10, whereby the piston can have a relatively limited contact surface with the housing 7, with the result that the cylinder, for a given movement of the piston rod 11, can be made relatively short. By moving the stop 23, the operating position for the piston rod 11 can be set so that the pressure medium consumption will be minimal when moving the workpiece between different welding points.

The embodiment shown here can of course be varied in a number of different respects, as desired and required, within the scope of the accompanying patent claims.

I claim:

1. In a cylinder with two-step movement, comprising a housing with a first and a second end piece, a first and a second piston sliding in contact with the inside of the housing, said second piston supporting a tube-shaped piston rod which moves sealingly through the first end piece of the housing, a pressure medium tube which is mounted in the second end piece and which passes through the first piston and extends into the tube-shaped piston rod and through which pressure medium can be led into or out of a first chamber between the first and the second pistons, and between the first end piece and the second piston a second chamber, and between the second end piece and the first piston a third chamber, the second and the third chambers each having a pressure medium connection; the improvement in which the end of the pressure medium tube extending into the piston rod has a contact portion adapted to contact the inside of the piston rod thus making the pressure medium tube serve as a guide both for the piston rod and for the second piston connected to the piston rod.

2. Cylinder according to claim 1, in which said contact portion comprises a slide sleeve mounted on the pressure medium tube.

3. Cylinder according to claim 2, in which said pressure medium tube and said slide sleeve have aligned openings therethrough that communicate between the interior of the pressure medium tube and said first chamber.

4. Cylinder according to claim 2, in which the end of the pressure medium tube remote from said second end piece has a radially outwardly extending flange against which one end of said slide sleeve abuts.

5. Cylinder according to claim 1, in which the pressure medium tube is a guide for the first piston as it moves.

6. Cylinder according to claim 5, in which the pressure medium tube has a stop for the first piston to limit its movement away from the second end piece.

7. Cylinder according to claim 6, in which said stop is adjustable axially of the housing.

8. Cylinder according to claim 7, in which said stop is rigidly mounted on the pressure medium tube which is in turn adjustable axially in the cylinder.

9. Cylinder according to claim 8, in which said pressure medium tube is screw-threadedly engageable within said second end piece, whereby axial adjustment of said pressure medium tube in said cylinder is effected by rotating said pressure medium tube relative to said second end piece.

10. Cylinder according to claim 1, in which the pressure medium tube extends with its end distant from the second end piece into the first end piece.

11. Cylinder according to claim 1, in which the pressure medium tube at its end distant from the second end piece is sealed against the inside of the piston rod.

12. Cylinder according to claim 11, in which said end of said pressure medium tube distant from said second end piece carries an annular seal that slides on and seals against the inside of the piston rod.

13. Cylinder according to claim 1, which is the cylinder of a welding gun for use in welding.

* * * * *